United States Patent [19]

Cory

[11] 4,079,579

[45] Mar. 21, 1978

[54] TRAVELLER

[75] Inventor: Albert Richard Cory, Cedar Knolls, N.J.

[73] Assignee: Coats & Clark, Inc., Stamford, Conn.

[21] Appl. No.: 654,937

[22] Filed: Feb. 4, 1976

[51] Int. Cl.[2] ..... D01H 7/60; D01H 7/62

[52] U.S. Cl. ..... 57/125; 252/12.4

[58] Field of Search ..... 57/125, 126, 119, 120; 252/12.4

[56] References Cited

U.S. PATENT DOCUMENTS

| | | | |
|---|---|---|---|
| 2,749,698 | 6/1956 | Stabli | 57/125 |
| 2,831,313 | 4/1958 | Burns et al. | 57/125 X |
| 3,134,219 | 5/1964 | Carter et al. | 57/125 |
| 3,387,447 | 6/1968 | Trammell et al. | 57/119 |
| 3,808,130 | 4/1974 | Schiefer et al. | 252/12.4 |

*Primary Examiner*—Richard C. Queisser
*Assistant Examiner*—Charles Gorenstein
*Attorney, Agent, or Firm*—Burgess, Ryan and Wayne

[57] ABSTRACT

A traveller for ring spinning and twisting is provided comprising a high modulus/low friction resin blended with a fibrous whisker material. A lubricant is usually added to the composition. The resulting traveller is characterized by a wear-life hitherto unavailable that is, a wear-life six to eight times greater than that of conventional travellers.

14 Claims, 4 Drawing Figures

HIGH MODULUS/LOW FRICTION RESIN COMPOSITION BLENDED WITH A FIBROUS WHISKER MATERIAL

HIGH MODULUS/LOW FRICTION RESIN COMPOSITION
BLENDED WITH A FIBROUS WHISKER MATERIAL

HIGH MODULUS/LOW FRICTION RESIN COMPOSITION
BLENDED WITH A FIBROUS WHISKER MATERIAL

HIGH MODULUS/LOW FRICTION RESIN COMPOSITION
BLENDED WITH A FIBROUS WHISKER MATERIAL

HIGH MODULUS/LOW FRICTION RESIN COMPOSITION
BLENDED WITH A FIBROUS WHISKER MATERIAL

TRAVELLER

The present invention relates to travellers which are used on spinning and twisting frames in the textile and the tire industry and more particularly, the present invention relates to a new, improved and greatly superior traveller which is characterized by a wear-life which has been hitherto unobtainable.

More specifically, the present invention is directed to a traveller for ring spinning and twisting comprising a composition containing (1) a high modulus/low friction resin such as, for example, acetals such as Celcon manufactured by the Celanese Company, Delrin manufactured by DuPont, and the like, polystyrenes manufactured by the Dow Chemical Company having a molecular weight of 230–280,000, styrene acrylonitriles such as those, for example, manufactured by Dow having a molecular weight of 200,000, acrylonitrile butadiene styrenes manufactured, for example, by Dow having a molecular weight of 200,000, polycarbonates, polyphenylene sulfides, nylons such as, for example, nylon 6/6, nylon 6/12 commercially known as Zytel resins manufactured by DuPont and thermoplastic polyesters such as Valox manufactured by the General Electric Co., blended with (2) a fibrous whisker material such as quartz (fibrous silica)
aluminum oxide
aluminum oxide and aluminum nitride
aluminum oxide and silicon carbide
silicon nitride
aluminum nitride
boron nitride
beryllium oxide
boron carbide
magnesium oxide and
graphite-carbon.

A lubricant such as molybdenum disulfide, silicone and fluorinated polymers such as TFE (polytetrafluoroethylene) may be advantageously added and this additional material will reduce the coefficient of friction and increase the wear life of the traveller.

Conventional travellers used, for example, in twisting modacrylic yarns have been made of either steel or bronze, the bronze being used mostly on wet twisting where the presence of water makes it undesirable to use steel. However, these travellers produced excessive heat during the twisting operation resulting in an evolution of noxious hydrochloric acid gas fumes from the yarn along with severe degradation of the traveller itself as well as machine corrosion. Then, as these travellers rotate around the ring at a high speed and in the case of twisting where the drag on the traveller is heavy, lubrication has been provided between the traveller and the ring and this lubrication has been in the form of an oil or grease. However, even where such lubrication is used, there is wear on the traveller and also on the ring and the fine particles of metal which are worn off become embedded in the grease and are subsequently oxidized forming visible stains on the yarns or threads. These stains consist of oxides, carbonates, soaps, and the like of the respective traveller and ring metals and are very difficult to remove in the ordinary processes of kier-boiling and bleaching.

Up to the present time, attempts have been made to produce travellers composed of materials other than steel and bronze and such travellers have been made using materials such as hard rubber and glass. However, these materials likewise have been unsatisfactory due to their brittleness and poor resistance against wear.

Further, in the past, travellers made of thermoplastic materials such as nylon, polystyrenes, cellulose ester, vinyl chloride and other polymers have been used as these substances are easily worked and formed. However, it has been found that such travellers when used, for example, in spinning or twisting modacrylic yarn or where, a heavy yarn material is used, are worn out by the heat developed by friction between the traveller and the ring or by the yarn cutting of the traveller. Additionally, the configuration of the traveller and the ring changes when heavily loaded and subjected to thread tension and centrifugal force over extended periods of time. In an attempt to overcome these deficiencies, the interior of the traveller has been reinforced with metal but while such travellers retain their original shape, they are susceptible to wear because of their thermoplastic surface.

It has now been found that the objectionable features associated with the prior art travellers are obviated by the present travellers which are composed of high modulus/low friction resins blended with fibrous whisker material. By the inclusion of such fibrous whisker materials, there is obtained a traveller possessing wear properties which are most surprising and unexpected and which have hitherto been unobtainable. Thus, it has been found that using the new and improved travellers of the present invention in, for example, spinning and twisting tire yarn and modacrylic yarns, such travellers exhibited wear properties as much as 6 to 8 times greater than those exhibited by present conventional travellers. The present new and improved travellers can be used, for the first time, in spinning and twisting modacrylic yarns. For example, where the wear life of a conventional traveller, as, for example, used in tire cord manufacture has been approximately 3 weeks (of 6 days each week), the present new and improved travellers have a wear life in excess of 16 such weeks. The present new and improved travellers additionally did not exhibit any excessive wear.

Among the high modulus/low friction resins useful in the present invention there are included acetals such as Celcon manufactured by the Celanese Company, Delrin manufactured by DuPont, and the like, polystyrenes manufactured by the Dow Chemical Company having a molecular weight of 230–280,000, styrene acrylonitriles such as those, for example, manufactured by Dow having a molecular weight of 200,000, acrylonitrile butadiene styrenes manufactured, for example, by Dow having a molecular weight of 200,000, polycarbonates and illustratively polycarbonates which are polycarbonates of bis-phenol (pp' dihydroxydiphenyldimethylmethane) identified as "Phenoxyl" and "Lexan" sold by Union Carbide and Chemical Company, and the General Electric Company, respectively; polyphenylene sulfides; nylons such as, for example, nylon 6/6, nylon 6/12 commercially known as Zytel resins manufactured by DuPont and thermoplastic polyesters such as Valox manufactured by the General Electric Company.

These high modulus/low friction resins are used in amounts varying between about 50 and about 80% by weight based on the total weight of the traveller and most suitably, in amounts ranging between about 60 and 70%, by weight.

The aforesaid resins are blended, using conventional procedures, with the fibrous whisker material. This fibrous whisker material which is present in amounts varying between about 20% and 40% by weight, of the composition and suitably between about 25 and 30%, increase the modulus and reduce the frictional property of the resin. Suitable fibrous whisker materials include, for example, quartz, aluminum oxide, aluminum oxide and aluminum nitride, aluminum nitride and silicon carbide, silicon nitride, aluminum nitride, boron nitride, beryllium oxide, boron carbide, magnesium oxide and carbon.

There can be blended together with the aforesaid ingredients, a lubricant such as, for example, molybdenum disulfide, silicone or fluorinated polymers and suitably, TFE (polytetrafluoroethylene). These lubricants are used in amounts varying between about 1 and about 20%, by weight, and suitably, in amounts varying between about 5 and 10%, by weight.

The shape of the travellers of the present invention is a conventional one; there is no limitation with respect to shape and the invention will be further illustrated by reference to the accompanying drawings, in which.

Figure 1:
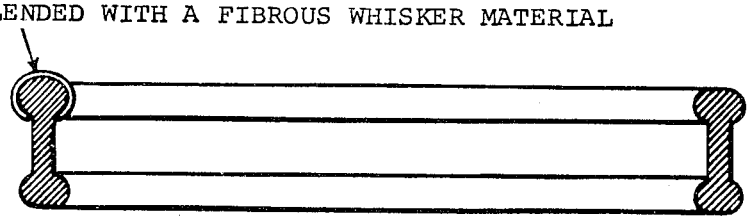
FIG. 1 shows one type of a conventional ring with a traveller mounted thereon.
Figure 2:
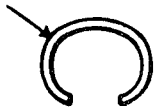
FIG. 2 shows a traveller for use with a ring of FIG. 1.
Figure 3:
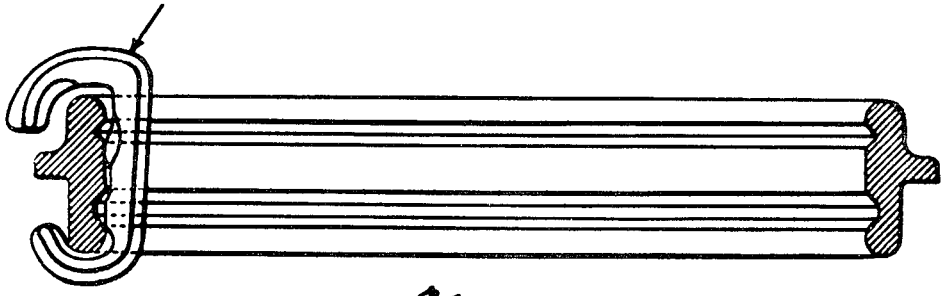
FIG. 3 shows another type of conventional ring with a traveller mounted thereon.
Figure 4:
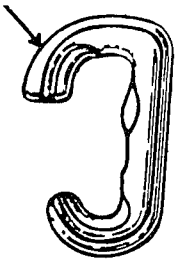
FIG. 4 shows a traveller for use with a ring shown in FIG. 3.

In accordance with the present invention, the travellers are prepared using the materials set out above. The high modulus/low friction resins are well known in the art and consequently, a further description of these resins is unnecessary. Since these resins are known, no claims are made to them per se, the invention being directed to a traveller which is wholly made from the aforesaid resins blended with a suitable lubricant and a fibrous whisker material, as described supra.

The travellers of the present invention are usually molded and the details of conventional molding procedures are well known. For example, the traveller is molded using a conventional screw type molding machine utilizing a temperature of about 530° F with an 11 second cycle time. The injection pressure used is about 800 PSI. There can be obvious variations in the molding procedure but the procedure generally is known to those skilled in the art.

The present resinous composition containing the fibrous whisker material and lubricant can also be used to produce conventional travellers containing an insert such as, for example, an insert composed of steel.

It is of course, to be understood that the present invention is by no means limited to particular embodiments described herein or illustrated in the drawing but the invention may also comprise any modifications with the scope of the appended claims.

What is claimed is:

1. A traveller for ring spinning and twisting comprising (1) a high modulus low friction resin selected from the group consisting of acetals, polystyrenes, styrene acrylonitriles, acrylonitrile butadienestyrenes, polycarbonates, polyphenylene sulfides, nylons and thermoplastic polyesters blended with (2) a fibrous carbon whisker material.

2. A traveller according to claim 1 wherein the resinous material is a nylon or a polyphenylene sulfide.

3. A traveller according to claim 2 wherein the nylon is a 6/6 nylon or a 6/12 nylon.

4. A traveller according to claim 2 wherein the resinous material is a polyphenylene sulfide.

5. A traveller according to claim 1 wherein the resinous material is present in amounts varying between about 50 and 80% by weight of the composition.

6. A traveller according to claim 5 wherein the resinous material is present in amounts varying between about 60 and 70%, by weight, of the composition.

7. A traveller according to claim 1 wherein the fibrous carbon whisker material is present in an amount varying between about 20 and 40%, by weight, of the composition.

8. A traveller according to claim 7 wherein the fibrous carbon whisker material is present in amounts varying between about 25 and 30%, by weight, of the composition.

9. A traveller according to claim 1 wherein a lubricant is blended into the composition containing the high modulus low friction resin and the fibrous whisker material, said lubricant being present in an amount varying between about 1 and 20%, by weight, of the composition.

10. A traveller according to claim 9 wherein the lubricant is present in an amount varying between about 5 and 15%, by weight, of the composition.

11. A traveller according to claim 9 wherein the lubricant is a member selected from the group consisting of molybdenum disulfide, silicon and a fluorinated polymer.

12. A traveller according to claim 9 wherein the lubricant is a polytetrafluoroethylene.

13. A traveller according to claim 1 comprising between about 60 and 70% nylon and the remainder carbon.

14. A traveller according to claim 1 comprising 55% nylon, by weight, of the composition, 30% carbon, by weight, of the composition and 15% polytetrafluoroethylene, by weight, of the composition.

* * * * *